US006682496B1

(12) United States Patent
Pivaroff

(10) Patent No.: US 6,682,496 B1
(45) Date of Patent: Jan. 27, 2004

(54) DEEP MUSCLE STIMULATOR DEVICE

(76) Inventor: Jake W. Pivaroff, 2711 E. Coast Hwy., Suite 206, Corona Del Mar, CA (US) 92625

( * ) Notice: Subject to any disclaimer, the term of this patent is extended or adjusted under 35 U.S.C. 154(b) by 181 days.

(21) Appl. No.: 09/473,792

(22) Filed: Dec. 28, 1999

(51) Int. Cl.[7] ..... A61H 1/00

(52) U.S. Cl. ..... 601/108; 601/97; 601/101; 601/107

(58) Field of Search ..... 601/70, 84, 97, 601/101, 107–108, 85, 87, 89, 93, 94, 102, 103, 109–111, 72, 80; 606/237–239

(56) References Cited

U.S. PATENT DOCUMENTS 1,787,211 A * 12/1930 Priest ..... 601/85
4,088,128 A * 5/1978 Mabuchi ..... 128/52
4,513,737 A * 4/1985 Mabuchi ..... 128/52
4,827,914 A * 5/1989 Kamazawa ..... 128/34
4,841,955 A * 6/1989 Evans ..... 128/52
4,858,600 A * 8/1989 Gross et al. ..... 128/65

* cited by examiner

*Primary Examiner*—Justine R. Yu
(74) *Attorney, Agent, or Firm*—James G O'Neill; Klein O'Neill & Singh, LLP

(57) ABSTRACT

A deep muscle stimulation device having a titanium hollow head with loosely packed granular materials held therein is reciprocally mounted in a hollow top and driven by a rotating electrical motor held in a hollow handle so as to provide deep muscle tissue with kinetic forms of percussion and concussion vibration so as to benefit damaged muscles in a patient. The hollow head is connected by a number of reciprocating elements to a finger on a rotating cam so as to have between a ⅛ to ½ inch stroke at a high rate of speed to provide deep penetrating muscle tissue stimulation. The device is easy to handle, and includes an on/off switch and an electrical cable-coupling element. The device is made from high strength materials, such as stainless steel or titanium, so as to hold up under heavy use by professionals in a number of disciplines. The granular materials fill approximately ⅓ the volume of the hollow head and are selected from diamonds, rubies, copper, bloodstone, garnet, malachite and carbon.

7 Claims, 2 Drawing Sheets

DEEP MUSCLE STIMULATOR DEVICE

BACKGROUND OF THE INVENTION

1. Field of the Invention

This invention relates generally to medical devices, and, more particularly, to a deep muscle stimulator device to increase muscle metabolism, increase the lactic acid cycle and to relieve pain.

2. Description of Related Art

Many types of a vibrating massage-type devices are known for use on different portions of a person's body, to help relieve stress, or tightened muscles. However, the known devices either do not vibrate at high enough speeds and/or do not provide sufficient force to reach deep muscle tissues.

Much of muscle pain stems from various conditions, caused by overstressing or over using muscles. These include strain, lactic acid build-up, scar tissue build-up, etc. The known prior art devices do not reach deep enough into the muscle tissues to provide the necessary relief for many persons. Therefore, there exists a need in the art for a deep muscle stimulator, such as the present invention, which uses percussion and mechanical vibrations that reach deep into the muscle tissue, to stimulate proprioceptive functions.

SUMMARY OF THE INVENTION

It is, therefore, a general object of the present invention to provide an improved muscle stimulation device. It is a particular object of the present invention to provide an improved deep muscle stimulation device, which provides deep muscle tissue with kinetic forms of percussion. It is another particular object of the present invention to provide an improved deep muscle stimulation device, which provides deep muscle tissue with concussion vibration to provide improved benefits for patients. It is yet another particular object of the present invention to provide an improved deep muscle stimulation device which provides increased circulation, increased performance, reduced pain, accelerated rehabilitation from injury, breakup of muscular scar tissue, reduced lactic acid build-up, increased flexibility, endurance and speed, and increased lymphatic flow. And, it is still another particular object of the present invention to provide an improved deep muscle stimulation device, which concentrates on general and/or local muscle spasms, to increase muscle metabolism and thereby increase the lactic acid cycle to thereby relieve pain.

These and other objects of the present invention are achieved by providing a deep muscle stimulation device having a body, which includes a holding portion with an electric motor held therein, and wherein the electric motor includes a rotating central arbor, which is coupled to a device for changing the rotational movement of the electric motor into reciprocating motion. And, wherein the motion-converting device is connected via a plurality of elements to a hollow movable head having a number of ingredients therein to apply pressure against selected portions of a patient's body, to thereby provide therapeutic results to the patient.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, wherein like reference numerals are used throughout the several views, and, in which:

DESCRIPTION OF THE PREFERRED EMBODIMENTS

Figure 1:
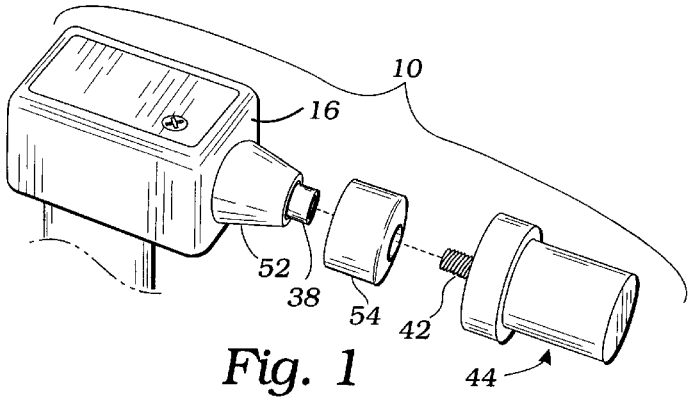
FIG. 1 is a partial exploded perspective view, with a portion broken away, of an improved deep muscle stimulation device of the present invention.
Figure 2:
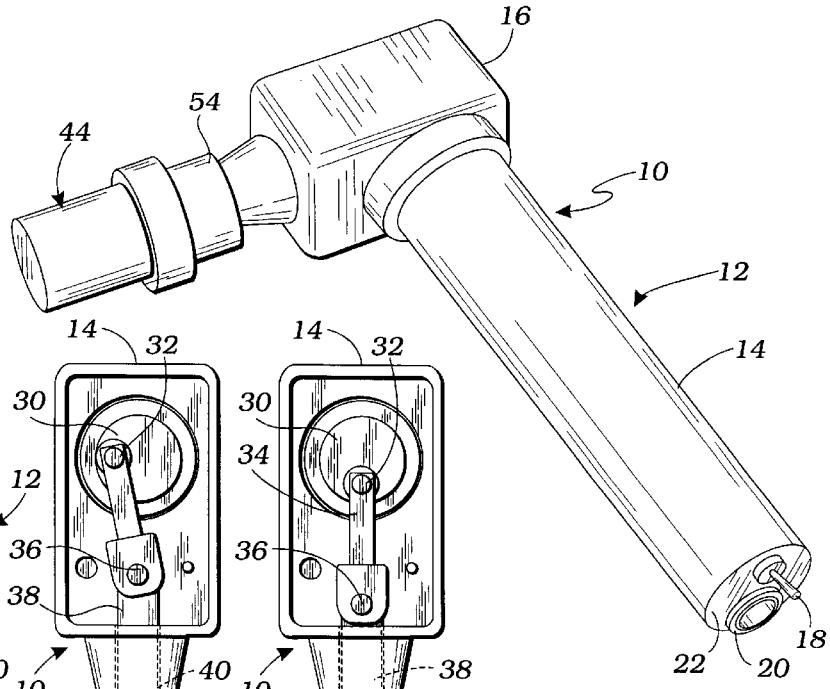
FIG. 2 is a further perspective view of an assembled deep muscle stimulation device of the present invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to provide for an improved deep muscle stimulation device, generally indicated by the numeral 10.

As shown in the drawings, the deep muscle stimulation device 10 of the present invention includes a body 12 comprised of an elongated, substantially hollow handle 14, a top element or housing 16, and a hollow head 44.

The elongated handle 14 is preferably made of metal, such as stainless steel or titanium, and includes an on/off switch 18 and an electric cable connection port 20, preferably formed flush with a bottom surface 22 of the handle 14. An electrical motor 24 is mounted within the elongated, hollow handle 14, and includes a central rotary arbor or shaft 26, driven by the motor. The rotary shaft 26 is coupled by any available or desired means, such as a coupling system 28 to an offset cam element or means 30, having an upwardly extending offset element or finger 32 connected to a reciprocating link 34. The reciprocating link 34 is coupled to a connecting element or rod 38, as by means of a pin 36, held in one or more openings formed in a first or inner end of the connecting element or rod 38. The inner end of rod 38 or an outer end or reciprocating link 34 may be bifurcated. The other or outer end of the rod 38 includes a recessed opening 40 formed therein. The recessed opening 40 captures one end of a connecting means, such as a pin 42, as by having screw threads formed therein. The other or outer end of the pin 42 is screw threaded or otherwise captured in the hollow head 44.

The hollow head 44 includes a hollow body 46 and a cap element 48 held thereon, as by means of threads formed there between. The hollow body 46 and cap 48 are preferably formed from titanium, or other suitable metal. The hollow body 46 includes an inner chamber, which contains loosely packed granular material 50. The granular material is loosely held within the hollow head and only fills between ¼ and ½ of the volume of the inner chamber, and preferably about one third. Various granular materials, such as diamond, ruby, copper, bloodstone, garnet, malachite or carbon are mixed together and inserted within the head 50. It has been found that various mixtures of these granular materials produce improved and superior results. Set forth below in tabular form are various preferred mixtures of the same, in grains, which preferably total between approximately 335 to about 500 grains:

| DIA | RUBY | COPPER | BLOODSTONE | GARNET | MALACHITE | CARBON | TOTAL GRAINS |
|---|---|---|---|---|---|---|---|
| 50 | 100 | 100 | 100 | | | | 350 |
| 30 | 50 | 200 | 20 | | | 50 | 350 |
| 75 | | 100 | 50 | 50 | 150 | 50 | 475 |
| 50 | 150 | 150 | 100 | | | 50 | 500 |
| 25 | 100 | 130 | 50 | 25 | | 50 | 380 |
| 15 | 35 | 200 | | | | 100 | 350 |
| 15 | 40 | 200 | | | | 100 | 355 |
| 50 | 75 | 100 | | 25 | | 100 | 350 |
| 10 | 25 | 200 | | | | 100 | 335 |
| 25 | 70 | 200 | | | | 100 | 375 |
| 20 | 30 | 200 | | | GOLD 20 | 100 | 370 |

In particular, it has been found that improved and extraordinary results are obtained by using a mixture of 10 grains of diamond, 25 grains of ruby, 200 grains of copper and 100 grains of carbon for a total of 335 grains of material. Although no explanation can be given for these surprising and unexpected results, it appears that somehow the movement of the mixed grains of material within the interior hollow chamber made from titanium, during reciprocally motion thereof, is transferred to a patient's body in an affected deep muscle area to produce improved and superior deep muscle relief.

Figure 6:
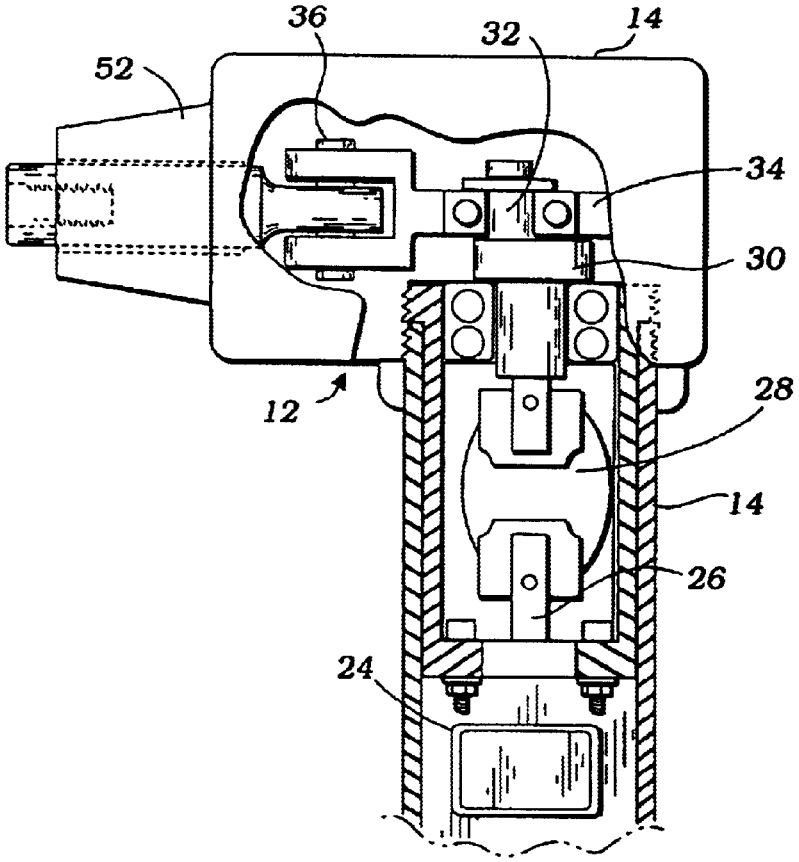
FIG. 6 is an enlarged partial cross-sectional view of the improved device of the present invention.

FIG. 6 is an enlarged partial cross-sectional view of the improved device of the present invention.

The top hollow housing 16 of the device 10 of the present invention is preferably made from the same material as the elongated handle 14, and includes a removable top plate and a truncated, pyramid-shape extending portion 52 which surrounds and provides protection around the reciprocating rod 38. In addition, a protective cup 54 is held between cap 48 of the head 44 and the portion 52 on the top housing 16 to provide further protection from the reciprocating rod 38.

Figure 3:
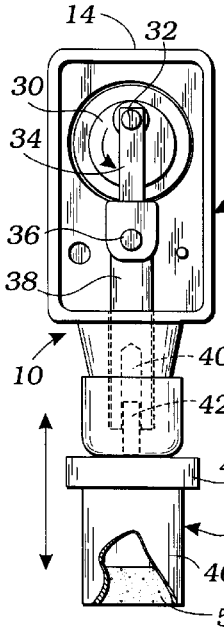
FIGS. 3–5 are top plan views of the deep muscle stimulation device, with a top plate removed, showing rotation of a cam and the reciprocating movement of a linkage and a partially broken away hollow head of the improved device of the present invention.
Figure 4:
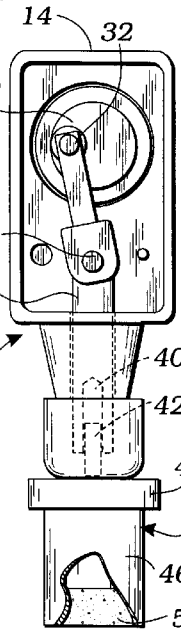
Figure 5:
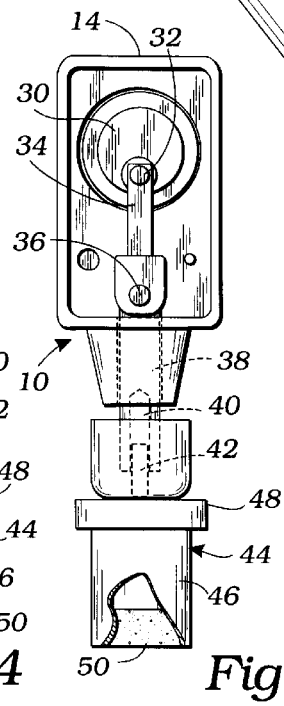

In operation, an electrical cable is connected into the connection port 20 to provide electricity to the motor 24. Upon operation of the on/off switch 18 the electric motor will be operated. Preferably, the electric motor operates at a speed of between about 2000 to 3600 RPM, so as to rotate the shaft 26 and coupling system 28 at that speed. This rotational speed is transferred to a reciprocating motion, as shown by arrow 56 in FIG. 3, whereby the head 44 is quickly reciprocated back and forth to provide sufficient percussion and mechanical vibrations against a portion of a patient to which it is applied by a user, to provide the deep muscle tissue within the patient's body with kinetic forms of percussion and concussion vibration. This stimulates the proprioceptive functions and provides relief in increasing strength for a person suffering from chronic pain and restricted movement to under conditioned and/or damaged muscle tissue. Furthermore, the selected mixture of granular materials in the hollow head 44 provide even further deep muscle relief.

The head 44 moves or reciprocates between approximately ⅛ and ½ of an inch, preferably about ¼ inch to provide maximum concussion and percussion, and, therefore, maximum muscle relief.

It, therefore, can been seen that the deep muscle simulation device of the present invention has been developed for use by professionals in the chiropractic, medical and physical therapy fields. These professionals may also include massage therapists, rehabilitation providers and sports trainers in all athletic disciplines. The deep muscle stimulation device of the present invention is used for a range of patients who suffer chronic pain in both everyday life and professional athletes. The device of the present invention produces effective and improved management of acute and chronic pain, including, but not limited to the following: migraine headaches, sciatica, TMJ, carpal tunnel syndrome, tendinitis, bursitis, edema and frozen joints.

Those skilled in the art will appreciate that various adaptations and modifications of the just-described preferred embodiments can be configured without departing from the scope and spirit of the invention. Therefore, it is to be understood that, within the scope of the appended claims, the invention may be practiced other than as specifically described herein.

What is claimed is:

1. A deep muscle stimulation device comprising, in combination:

a body having an elongated hollow handle with an on/off switch, an electrical connection and an electrical motor held therein;

a hollow top housing being connected to the elongated hollow handle;

a cam element having a finger held therein held in the hollow top housing;

the cam element coupled to the electric motor to translate rotary motion of a shaft of the electric motor to reciprocating motion of a titanium hollow head;

the titanium hollow head being attached to a linkage means coupled to the finger to allow reciprocation of the hollow head a predetermined amount, in a rapid manner, determined by the speed of the electrical motor;

the titanium hollow head having a hollow inner chamber with granular material held therein and filing between ¼ and ½ of the volume of the hollow inner chamber; and the hollow inner chamber having approximately 10 grains of granular diamonds, 25 grains of granular rubies, 200 grains of granular copper and 100 grains of carbon therein.

2. The deep muscle stimulation device of claim 1 wherein the hollow head is comprised of a titanium hollow body and a titanium cap secured to the hollow body, and the titanium cap is secured to the linkage means.

3. The deep muscle stimulation device of claim 2 wherein the linkage means includes a rod and a link, secured together by a holding means.

4. A deep muscle stimulation device comprising, in combination:

a body having an elongated hollow handle with an on/off switch, an electrical connection and an electrical motor held therein;

a hollow top housing being connected to the elongated hollow handle;

an offset means held in the hollow top housing and coupled to the electric motor to translate rotary motion of a shaft of the electric motor to reciprocating motion of a titanium hollow head;

the titanium hollow head being attached to a rod and a link coupled to the offset means to allow reciprocation of the titanium hollow head a distance of between about ⅛" and ½" in a rapid motion;

the titanium hollow head having a hollow inner chamber with granular material held therein and filing between about ¼ and ½ of the volume of the hollow inner chamber;

the offset means being a cam element having a finger held therein, and the cam element being rotatably secured to the electrical motor by a coupling element whereby the finger is rotated, and wherein the finger is coupled to the link to reciprocate the rod and attached titanium hollow head; and the hollow inner chamber contains approximately 335 grains of a mixture of granular diamonds, rubies, copper and carbon.

5. The deep muscle stimulation device of claim 4 wherein there are approximately 10 grains of granular diamonds, 25 grains of granular rubies, 200 grains of granular copper and 100 grains of carbon.

6. A deep muscle stimulation device comprising, in combination:

a metal body having an elongated hollow handle with an on/off switch, an electrical connection and an electrical motor held therein;

a metal hollow top housing being connected to the elongated hollow handle;

a cam element held in the hollow top housing and coupled to the electric motor to translate rotary motion of a shaft of the electric motor to reciprocating motion of the titanium hollow head;

the titanium hollow head being attached to a pin, a rod and a link coupled to the cam element to allow reciprocation of the titanium hollow head in a rapid manner, determined by the speed of the electrical motor;

the hollow head having a hollow inner chamber with granular material held therein and filing approximately ⅓ of the volume of the hollow inner chamber;

the cam element having a finger held therein, and wherein the finger is coupled to the link to reciprocate the hollow head through the rod and pin between about ⅛" to about ½"; and the hollow inner chamber contains approximately 335 grains of granular diamonds, rubies, copper and carbon.

7. The deep muscle stimulation device of claim 6 wherein there are approximately 10 grains of granular diamonds, 25 grains of granular rubies, 200 grains of granular copper and 100 grains of carbon.

* * * * *